US007423542B1

(12) United States Patent
Mitsis et al.

(10) Patent No.: US 7,423,542 B1
(45) Date of Patent: Sep. 9, 2008

(54) WATER DETECTION SENSING SYSTEM

(75) Inventors: Charles W. Mitsis, Scottsdale, AZ (US); Scott Boster, Scottsdale, AZ (US)

(73) Assignee: SpectraPure, Inc., Tempe, AZ (US)

( * ) Notice: Subject to any disclaimer, the term of this patent is extended or adjusted under 35 U.S.C. 154(b) by 215 days.

(21) Appl. No.: 11/077,949

(22) Filed: Mar. 11, 2005

(51) Int. Cl.
*G08B 21/00* (2006.01)

(52) U.S. Cl. ..... 340/618; 340/608

(58) Field of Classification Search ..... 340/608, 340/605, 618
See application file for complete search history.

(56) References Cited

U.S. PATENT DOCUMENTS 4,246,575 A * 1/1981 Purtell et al. ..... 340/605

7,128,929 B1 * 10/2006 Scherr ..... 424/443

* cited by examiner

*Primary Examiner*—George A Bugg
*Assistant Examiner*—Shirley Lu
(74) *Attorney, Agent, or Firm*—LaValle D. Ptak; Michael T Wallace

(57) ABSTRACT

A water detection signal generator includes a water-sensing member with a first surface which is movable from a first position to a second position upon contact with water by the sensing member. A movement responsive device is coupled with the first surface of the sensing member and is operated by movement of the first surface from the first position to the second position thereof.

18 Claims, 2 Drawing Sheets

WATER DETECTION SENSING SYSTEM

BACKGROUND

This invention relates to the field of detecting the presence of water leaks, such as caused by hot water tank leaks, pipe leaks, leakage in reverse osmosis systems, washing machine pipe breaks and the like. It is desirable to detect the presence of such leaks and activate an alarm and/or shut down or isolate the source of water from the leak to prevent damage to the area surrounding the presence of the leak.

DETAILED DESCRIPTION

Figure 1:
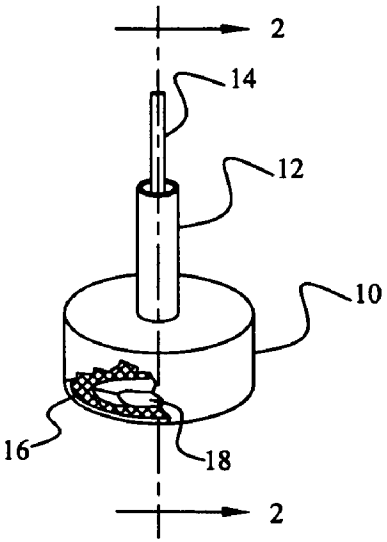
FIG. 1 is a top partially cut away perspective view of an embodiment of the invention.
Figure 3:
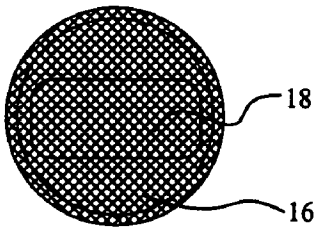
FIG. 3 is a bottom view of the embodiment shown in FIGS. 1 and 2.

Reference now should be made to the drawings in which the same reference numbers are used in the various figures to designate the same or similar components. FIG. 1 is a top perspective partially cut away view of an actuator mechanism constructed in accordance with an embodiment of the invention. The actuator mechanism includes a hollow cylindrical housing 10 made of any suitable material, but typically made of plastic. The housing 10 has an open bottom in which a porous screen 16 is fitted to allow penetration by water to the interior of the housing 10. The top of the housing 10 has an outer fixed sheath 12 coupled to it. As evidenced in the cross-sectional views of FIGS. 2 and 4, the interior of the sheath 12 carries a movable actuator member or rod 14, which may be rigid or which may be in the form of a cable of the type typically used for brake operating cables and the like. The rod 14 is recriprocally movable within the outer fixed sheath 12.

The end of the actuator rod 14, which is located within the housing 10, is connected to a piston 20. In the embodiment of FIGS. 1 through 4, the piston 20 is in the form of a flat circular disk. The piston 20 also may be made of any suitable rigid material; and it is mounted for reciprocal movement within the interior of the hollow housing 10, as is most apparent from an examination of FIGS. 2 and 4.

Figure 2:
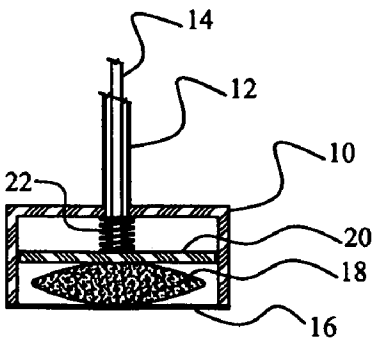
FIG. 2 is a cross-sectional view taken along the lines 2-2 of FIG. 1 showing the embodiment in a first position of operation.
Figure 4:
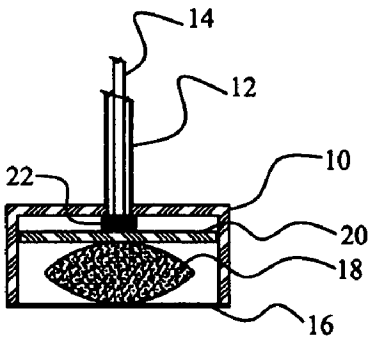
FIG. 4 is a cross-sectional view taken along the same cross section as FIG. 2 showing the embodiment in a different position of operation.

Fitted between the water permeable screen 16 on the bottom of the housing 10 and the underside of the piston 20, sensing material 18, which exhibits the property of relatively rapid expansion upon exposure or immersion in water, is located. The sensing material may be in the form of pellets of sodium polyacrylate polymer, or other similar materials exhibiting the property of rapid expansion when the material is contacted by water. The entire region between the screen 18 and the underside of the piston 20 may be filled with such material, or, as is exhibited in FIGS. 1 through 4, the sodium polyacrylate polymer or other material 18 is contained within a bag or pouch made of water permeable cloth or paper material, such as used for tea bags and the like. Whether the material 18 occupies all or most of the space between the bottom of the piston 20 and the permeable screen 16, a sufficient amount of the material 18 is provided to produce at least one dimension of movement (vertically, as shown in FIGS. 2 and 4) upon contact with water. The upper surface of the material 18 which presses against the bottom of the piston 20 moves the piston 20 from a first normal or inactive position shown in FIG. 2 to a second active position shown in FIG. 4, where the piston 20 is driven toward the top of the housing 10. The piston 20 normally is lightly biased into contact with the top of the material 18 by means of a compression coil spring 22, which is placed around the shaft 14 and between the top of the piston and the inner side of the top of the housing to normally bias the piston 20 to the position shown in FIG. 2. Other biasing means, such as compressible foam or the like also may be used.

When the expandable sensing material 18 contacts water, it expands at least upwardly (as shown in FIG. 4) to move the piston 20 upwardly and therefore drive the shaft 14 upwardly, as shown in FIG. 4. The amount of distance which is employed for various applications of the actuator sensing mechanism may be from as little as ⅛" to 1", depending upon the particular environment in which the actuator mechanism is employed.

In summary, the actuator mechanism which has been described above in conjunction with FIGS. 1 through 4 is utilized by placing the housing 10 in the upright position shown in FIGS. 1, 2 and 4; so that the screen 16 is located on the surface where a water leak is likely to produce the presence of water. If such a leak occurs, water in this location enters the water permeable housing 10 through the screen 16 to contact the expandable sensing material 18. The material 18 then expands to move the piston 20 from the position of FIG. 2 to the position shown in FIG. 4. This is a purely mechanical movement, without requiring any electrical sensors or electrical connections whatsoever in order to effect the operation of the actuator mechanism by forcing the rod 14 upwardly in the direction of the arrow shown in FIG. 4.

Figure 6:
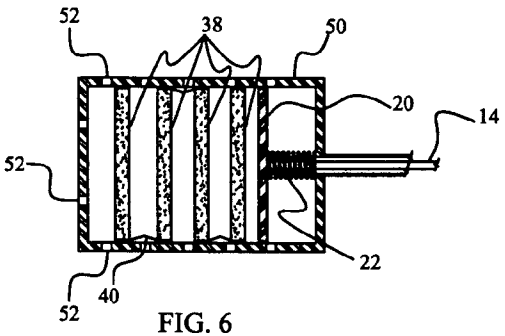
FIG. 6 is a cross-sectional view of another embodiment of the invention employing the components of FIG. 5.
Figure 5:
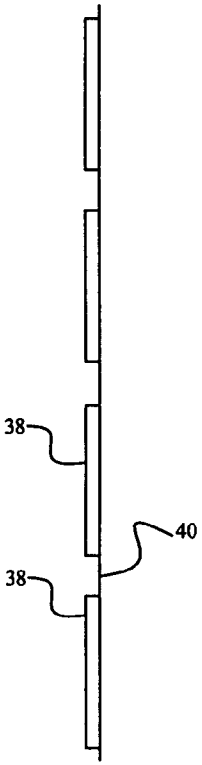
FIG. 5 is a side view of an alternative of one of the components shown in FIGS. 1 through 4.

FIG. 5 illustrates an alternative to the single bag or pillow of expanding sensing material 18, which has been shown and described in conjunction with FIGS. 1 through 4. In FIG. 5, multiple pouches 38 of expandable sensing material 18 are interconnected by means of a membrane 40 attached to one of their surfaces. These pouches 38 then can be folded in a zig-zag fashion and placed within a housing, such as the housing 10 shown in FIGS. 1, 2 and 4, or into a housing 50, such as shown in FIG. 6. The housing 50 also may be of a cylindrical configuration; or it may have a rectangular cross sectional configuration. Obviously, the interior configuration of the hollow housing 50 will dictate the exterior configuration of interior pistons and of the pouches 38 of expandable material. This also is true of the variations of the embodiment shown in FIGS. 1 through 4. Irrespective of the particular shape of the housing 50, the housing 50 is shown as placed on its side on a surface such as a floor or ground where water leak detection is desired.

The housing 50 has holes or openings 52 on its sides, top and bottom to allow water which may be present where the housing is placed to readily and rapidly enter the housing. At the right-hand end of the housing 50, a piston 20 attached to a shaft 14 and biased toward the left by a spring 22 is located. The manner in which this is done is comparable to the biasing and location of the piston shown in FIGS. 2 and 4. The zig-zag folded pouches 38 of expandable sensing material, such as sodium polyacrylate polymer or other similar materials are placed between the piston 20 and the left-hand or opposite end of the housing 50, as shown in FIG. 6. Whenever the presence of water is sensed, the pouches of expandable material 38 expand and press against the piston 20 to drive it toward the right in the same manner as described above in conjunction with FIGS. 2 and 4. The actuator 14 then moves in the direction of the arrow shown in FIG. 6 to operate whatever mechanism is attached to it for response to the sensing of water by the actuator system shown in FIG. 6.

Figure 7:
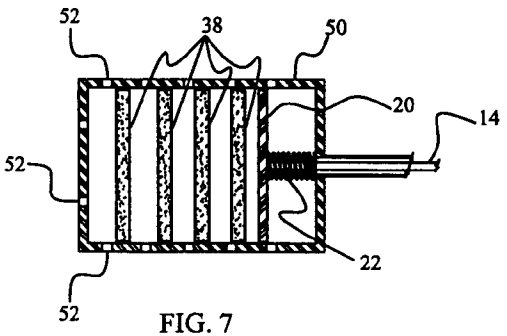
FIG. 7 is a cross-sectional view of an embodiment similar to the one shown in FIG. 6.

FIG. 7 is a variation on the embodiment shown in FIG. 6, in which multiple separate pouches of expandable sensing material 38 are located between the piston 20 and the end of the housing 50. In the embodiment of FIG. 7, however, the pouches 38 are not interconnected by a membrane 40, but are independent of one another. The operation, however, is the same as described in conjunction with the embodiment of FIG. 6.

Figure 8:
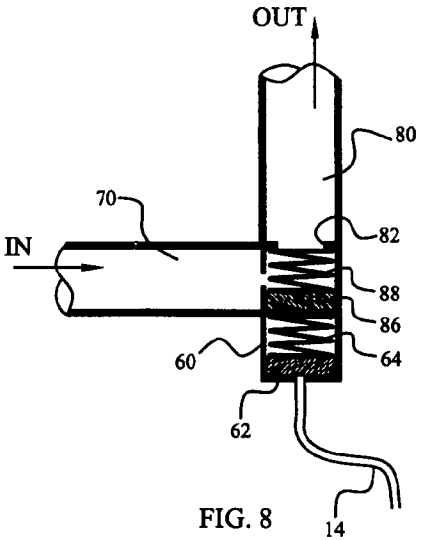
FIG. 8 is a diagrammatic representation of a valve which may be operated by the embodiments of FIGS. 1 through 4, 6 and 7.

FIG. 8 is a diagrammatic representation of a manner of utilization of the operation of any of the actuator mechanisms which have been shown and described in conjunction with FIGS. 1 through 7. In FIG. 8, the distal end of the movable actuator rod 14 is shown connected to a magnet 62 located in a guide or housing 60 and biased downwardly (as shown in FIG. 8) by a coil spring 64. This magnet 62 is located adjacent a magnetic valve actuator 86 located between an inlet water pipe 70 and an outlet water pipe 80. The magnetic valve actuator 86 also is biased downwardly (as shown in FIG. 8) by a spring 88; and when all of the parts are in the relative location as shown in FIG. 8, water flowing into an inlet pipe 70 passes through the valve and out of an outlet pipe 80. If the actuator rod 14, however, moves upwardly as shown in FIG. 8 (and as described in FIG. 4, or to the right as shown in FIGS. 6 and 7), the magnet 62 is moved upwardly against the force of the spring 64 to locate it in close proximity to the magnet 86. The magnets 62 and 86 are mounted with opposing polarities; so that when the magnet 62 moves upwardly it repels the magnetic actuator 86 upwardly against the retaining spring 88 to seat the magnetic actuator 86 against a valve seat 82 to close the valve. Consequently, water present in the input pipe 74 cannot pass through the valve to the outlet 80. Valves that operate in a similar method include, for example, a magnetically operated pilot valve.

Figure 9:
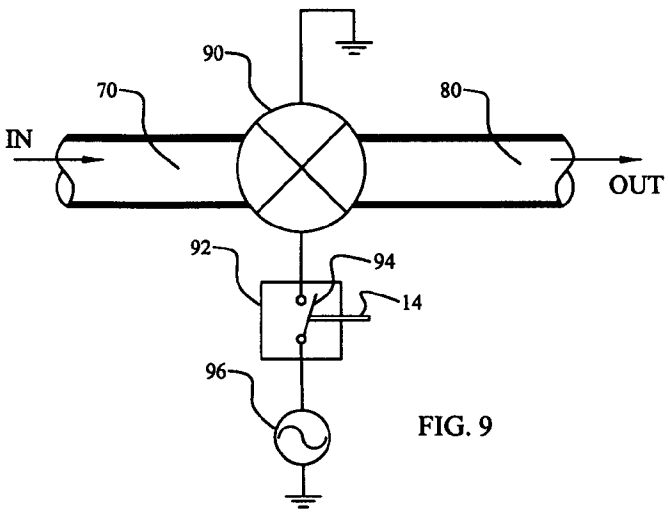
FIG. 9 is a diagrammatic view of an alternative utilization of the operation of the embodiments of FIGS. 1 through 4, 6 or 7.

FIG. 9 is another variation illustrating the application of the operation of the actuators shown in FIGS. 1 through 7 where the inlet pipe 70 is connected to the water outlet pipe 80 through an electric valve 90. Normally, the valve 90 is open. If the movable shaft 14, however, is moved from its first position to its activated or second operated position it causes the contact arm 94 of a micro-switch 92 to close an electrical contact between an electrical source 96 and the valve 90. This applies operating power to close the valve 90. In both FIGS. 8 and 9, so long as the movable actuator rod 14 remains in its second position (operated), the valve is closed until the actuator mechanism is reset.

Movement of the actuator rod 14 by means of the expansion of the expandable material 18 or 38 also can be used to operate an alarm or other systems designed to respond to the presence and detection of a water leak in the area where the devices of FIGS. 1 through 7 may be place.

The particular materials which are used for the expandable sensing materials 18 or 38 also may be chosen to exhibit a characteristic of permanent expansion once they have been placed in contact with water. This means that if the water leak which was originally detected is not fixed and the originally sensed puddle of water evaporates, the system does not continue to repeat a cycle of operation (off and on, and back again). Once expanded, the material remains expanded until the necessary repairs are made, and until replacement of the actuator material 18 or 38 within the housing 10 or 50 (or the entire actuator unit) is effected.

The operation of the device does not require any plumbing or electrical connections whatsoever. The housings 10 or 50 simply may be placed on a surface adjacent an area where leakage detection is desired; and the actuator rod 14 then may be connected to the desired utilization device, such as the ones shown in FIGS. 8 and 9, by way of example. The utilization devices may be located in close proximity to the housings 10 or 50, or may be some distance away, since the rod 14 may be selected to be a flexible non-extendable cable in a flexible sheath 18 of the type described above as being similar to a brake cable in an automobile. All that is necessary is for the movement of the actuator rod 14 to be sufficient to effect the desired operation whether it be the operation of a microswitch, a magnetic valve, or any other type of utilization device which responds to mechanical movement.

The foregoing description of the various embodiments of the invention is to be considered as illustrative, and not as limiting. Various changes and modifications will occur to those skilled in the art for performing substantially the same function, in substantially the same way, to achieve substantially the same result without departing from the true scope of the invention as defined in the appended claims.

What is claimed is:

1. A water detection signal generator including in combination: a water sensing member of expandable material having a first surface movable from a first unexpanded position to a second expanded position upon contact with water by the sensing member; and a magnetically actuated valve coupled with the first surface and operated by movement of the first surface from the first position to the second position thereof.

2. A water detection signal generator according to claim 1 wherein the water sensing member comprises super absorbent polymer.

3. A water detection signal generator according to claim 2 where the super absorbent polymer is sodium polyacrylate polymer.

4. An actuator mechanism including in combination: a water permeable housing; a reciprocally movable actuator member extending through the housing for movement therethrough; expandable material confined in the housing and coupled with the movable actuator member; the expandable material normally in an unexpected condition and expanding upon contact with water to move the actuator member from a first position to a second position.

5. An actuator mechanism according to claim 4 wherein the expandable material is sodium polyacrylate polymer.

6. An actuator mechanism according to claim 5 wherein the movable actuator member is an elongated cable.

7. An actuator mechanism according to claim 4 further including a piston in the housing connected to the movable actuator member and located in contact with the expandable material.

8. An actuator mechanism according to claim 7 wherein the housing is a hollow cylindrical housing with a water permeable bottom and a top through which the movable actuator member extends.

9. An actuator mechanism according to claim 8 wherein the piston is of a circular configuration and the outer circumference is dimensioned to slidably move within the interior of the hollow cylindrical housing.

10. An actuator mechanism according to claim 9 further including a spring member for biasing the piston into contact with the expandable material.

11. An actuator mechanism according to claim 10 wherein the spring member is a coil spring extending between the piston and the top of the housing.

12. An actuator mechanism according the claim 10 wherein the spring member comprises compressible foam located between the piston and the top of the housing.

13. An actuator mechanism according to claim 5 further including a piston in the housing connected to the movable actuator member and located in contact with expandable material.

14. An actuator mechanism according to claim 13 wherein the housing is a hollow cylindrical housing with a water permeable bottom and a top through which the movable actuator member extends.

15. An actuator mechanism according to claim 14 wherein the piston is of a circular configuration and the outer circumference is dimensioned to slidably move within the interior of the hollow cylindrical housing.

16. An actuator mechanism according to claim 13 further including a spring member for biasing the piston into contact with the expandable material.

17. A valve operator system including in combination; a reciprocally movable actuator member; a hollow cylindrical water permeable housing with a bottom and with a top having an aperture therein for movement of the actuator member therethrough; a piston coupled to the actuator member within the housing and reciprocally movable within the housing; water-responsive expandable sensing material located within the housing between the piston and the bottom of the housing; a biasing member located between the piston and the inside of the top of the housing for biasing the piston into a first position in contact with the sensing material in its unexpanded condition, whereupon contact by the sensing material with water causes the sensing material to expand to move the piston from the first position to a second position located nearer the top of the housing, thereby pushing the actuator member outwardly from the housing.

18. A valve operator according to claim 17 wherein the bottom of the housing is a water permeable screen.

* * * * *